US005460269A

United States Patent [19]

Bayer

[11] Patent Number: 5,460,269

[45] Date of Patent: Oct. 24, 1995

[54] SKIN PACKAGING

[75] Inventor: George Bayer, Plattsburgh, N.Y.

[73] Assignee: Schonbek Worldwide Lighting Inc., Plattsburgh, N.Y.

[21] Appl. No.: 19,037

[22] Filed: Feb. 18, 1993

[51] Int. Cl.[6] ..... B65D 65/00

[52] U.S. Cl. ..... 206/497; 206/6.1; 206/484.1; 206/524.8; 428/67; 428/69; 428/201; 428/311.1

[58] Field of Search ..... 206/45.33, 461, 206/463, 471, 484, 484.1, 489, 6.1, 497, 524.8; 428/67, 68, 69, 201, 311.1, 36.5

[56] References Cited

U.S. PATENT DOCUMENTS

| | | | |
|---|---|---|---|
| 2,861,405 | 11/1958 | Hanford | 53/22 A |
| 2,876,899 | 3/1959 | Maynard, Jr. | 206/45.33 |
| 3,253,705 | 5/1966 | Stoker, Jr. | 206/56 |
| 3,270,482 | 9/1966 | Kraut | 53/30 |
| 3,338,400 | 8/1967 | Edgworth et al. | 206/484 |
| 3,358,829 | 12/1967 | Smith et al. | 206/80 |
| 3,474,952 | 10/1969 | Cover, Jr. et al. | 229/53 |
| 3,534,521 | 10/1970 | Rorer | 53/22 A |
| 3,595,722 | 7/1971 | Dawbarn | 156/177 |
| 3,648,428 | 3/1972 | Colburn | 53/22 A |
| 3,756,399 | 9/1973 | Cosier et al. | 206/45.33 |
| 3,809,217 | 5/1974 | Harrison | 206/484 |
| 3,895,983 | 7/1975 | Lang et al. | 428/119 |
| 4,015,051 | 3/1977 | Offermann et al. | 428/523 |
| 4,040,515 | 8/1977 | Hessel et al. | 206/484 |
| 4,055,672 | 10/1977 | Hirsch et al. | 206/484 |
| 4,062,449 | 12/1977 | Popkes et al. | 206/471 |
| 4,083,451 | 4/1978 | Hair | 206/461 |
| 4,101,353 | 7/1978 | Watson | 156/49 |
| 4,375,851 | 3/1983 | Paulos | 206/471 |
| 4,411,364 | 10/1983 | Friedman | 206/466 |
| 4,889,731 | 12/1989 | Williams, Jr. | 206/484.1 |
| 4,927,691 | 5/1990 | Bekele | 428/35.2 |
| 4,956,212 | 9/1990 | Bekele | 428/36.6 |

FOREIGN PATENT DOCUMENTS

| | | |
|---|---|---|
| 2495108 | 6/1982 | France . |
| 2134427 | 1/1973 | Germany . |
| 3004519 | 8/1981 | Germany . |
| 1039851 | 8/1966 | United Kingdom . |

*Primary Examiner*—George F. Lesmes
*Assistant Examiner*—Blaine R. Copenheaver
*Attorney, Agent, or Firm*—Wolf, Greenfield & Sacks

[57] ABSTRACT

A skin package according to this invention is formed by providing a backing sheet and positioning an article on the backing sheet at an appropriate point. An intermediate sheet of porous substantially inelastic material is then overlaid on the article. The intermediate sheet is then covered with a skin sheet that becomes elastic and adheres to the backing sheet at predetermined locations upon exposure to predetermined conditions. These predetermined conditions do not substantially alter the inelasticity of the intermediate sheet so that the intermediate sheet prevents the skin sheet from encapsulating the article.

12 Claims, 5 Drawing Sheets

SKIN PACKAGING

FIELD OF THE INVENTION

This invention relates to skin packaging and a method for constructing skin packages.

BACKGROUND OF THE INVENTION

In recent years, skin packaging has become a common method for packing loose articles. Skin packaging usually entails the sandwiching of an article between a substantially rigid backing sheet, such as cardboard, and a closely fitting overlaid layer of plastic material. The plastic material is generally clear so that the article can be viewed.

A skin package is typically constructed by first laying the article onto the backing sheet. The backing sheet can be covered with adhesive and often includes a series of small diameter through-cut punctures across its surface that allow air to pass through the sheet. Once the article is placed in an appropriate position upon the sheet, a flexible plastic sheet (the "skin") is then laid over the article and backing sheet. The skin sheet can be heated before or during its overlay onto the backing sheet so that it binds with the adhesive and deforms plastically to wrap around the article. Substantially simultaneously to heating, a vacuum is applied through the bottom of the backing sheet that pulls air through the backing sheet punctures. The generated suction causes the heated, now highly deformable, skin sheet to be drawn toward the backing sheet and adhere firmly and tightly to the backing sheet's adhesive layer with few air bubbles. The suction also causes the skin to be drawn tightly around the article, conforming to all the article's outer contours. As noted above, the introduction of heat induces flexibility and plastic deformability that facilitates the conformation of the sheet to the article's surface contours. When the skin cools it maintains its closely conforming shape.

While a closely conforming skin sheet serves to prevent any undue movement of the article, thus providing a secure package, it also tends to cause encapsulation of the article. By encapsulation, it is meant the property whereby the skin undercuts the bottom of the article and/or binds so closely to the edges of the article that it cannot be easily removed from the skin package when desired. An example of an encapsulated article, a crystal jewel 10 in this example, is illustrated in the exemplary prior art, skin package 11 shown in FIG. 1. The package 11 comprises a backing sheet 12 having an adhesive layer 14 that binds to a skin sheet 16. Note that the skin 16 has undercut the jewel 10 at positions 18.

Typically an article is removed from a skin package by tracing around the article with a knife and peeling the overlying layer of skin off the article. Thus, the package should ideally be formed so that there is at least a small unconnected (unadhered) boundary between the article and the backing sheet, thus facilitating easy removal of the skin overlying the article. However, when encapsulation occurs as shown in FIG. 1, the knife blade (shown schematically as 21) cannot easily access the unconnected boundary 20 of the skin package 11 since it is very close to the jewel 10. Therefore, to avoid contacting the jewel, the blade must be positioned (as shown) along the connected part of the boundary. The overlying skin 22 is still adhered to the backing sheet 12, and a substantial tearing force must still be utilized to remove the overlying skin 22 from the backing sheet 12. Alternatively, the knife blade 21 must be brought undesirable close to the jewel 10 to cut at the unconnected boundary 20, risking possible damage of the jewel surface through contact with the blade.

A further disadvantage of current skin packaging techniques is that the overlying skin 22 often becomes adhered through melting and/or surface tension, to the article. This is because the highly flexible skin is placed into direct contact with the article under high vacuum-induced pressure. Removal of tightly adhering skin from delicate items such as gold chains and crystal jewel links can require substantial force, causing damage, and can entail substantial labor.

Direct contact between the article and skin can be limited by providing an intermediate layer between the skin and article. In the past, certain packagers have employed padding such as plastic bubble wrap between the article and the skin. The bubble wrap provides a thick layer between the skin and underlying article that limits encroachment of the skin around the article. However, bubble wrap is so thick that it typically prevents the skin from tightly securing the article. As such, a large cavity around the article is generated that allows the article to move excessively within the skin package. Similarly, bubble wrap is not permeable to air and, thus, the vacuum is incapable of drawing the skin close to the article in the vicinity of the bubble wrap further limiting package security.

Accordingly, it is one object of this invention to provide a skin packaging method that ensures firm and stationary placement of the article in the skin package, but provides an expanded, unsealed boundary between the skin and backing sheet around the article that facilitates removal of the article from the package. It is another object of this invention to provide a skin package method that generally prevents encapsulation of the skin packaged article and that ensures that the skin does not adhere to the article.

SUMMARY OF THE INVENTION

A skin package according to this invention is formed by first providing a substantially rigid backing sheet, such as cardboard, and positioning an article on the backing sheet at an appropriate point. An intermediate layer or sheet of porous, substantially-inelastic material is then overlaid on the article. The intermediate sheet is typically sized so that its edges extend outwardly further that the perimeter edges of the article and contact the backing sheet. The intermediate sheet is then covered with a skin sheet that becomes elastic and adheres to the backing sheet at predetermined locations upon exposure to predetermined conditions. These predetermined conditions do not substantially alter the inelasticity of the intermediate sheet so that the intermediate sheet generates a "tenting" effect in the skin sheet that prevents the skin sheet from encapsulating the article.

According to one embodiment, the predetermined conditions to which the skin is exposed comprise heating of the skin and application of a vacuum through the backing sheet. As such, the skin sheet becomes flexible and is drawn by the vacuum into contact with the backing sheet. The backing sheet can include adhesive that interacts with the skin sheet. The intermediate sheet can comprise a filter material and can include enlarged perforations that enable the drawn skin sheet to contact the adhesive of the backing sheet through the perforations. As such, the skin sheet can be secured to the backing sheet at points close to the edges of the article, while still not encapsulating the article.

A skin packaged article according to this invention is constructed by providing a substantially-rigid backing sheet. The article is positioned on the backing sheet. This article has perimeter edges. A substantially inelastic intermediate sheet is overlayed over the article. The intermediate sheet has edges that extend outwardly beyond the perimeter edges of the article. The intermediate sheet edges contact the backing sheet and, typically, extend along the backing sheet over a predetermined distance. A skin sheet is applied over the intermediate layer. The skin sheet is adhered to the backing sheet at points proximate to the intermediate layer and remote from the perimeter edges of the article. The skin sheet can include edges that extend outwardly further than the edges of the intermediate layer. Additionally, the intermediate sheet edges can extend outwardly in contact with the backing sheet a distance that supports the skin sheet and limits in capsulation of the article by the skin sheet upon application of a vacuum thereto, thereby providing an unadhered portion of the skin sheet to the backing sheet in the vicinity of the article.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION

Figure 1:
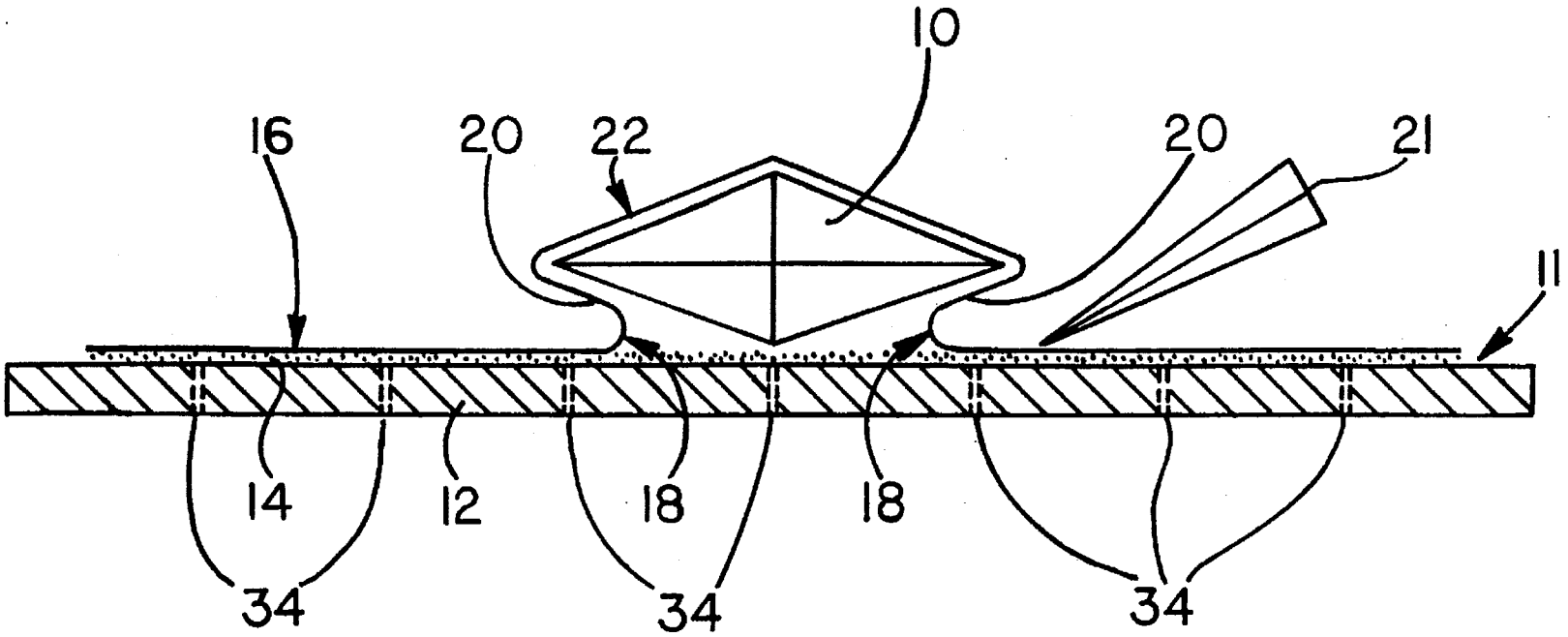
Fig. 1 (PRIOR ART)
FIG. 1 is a side cross-section of a skin packaged crystal jewel according to the prior art.
Figure 2:
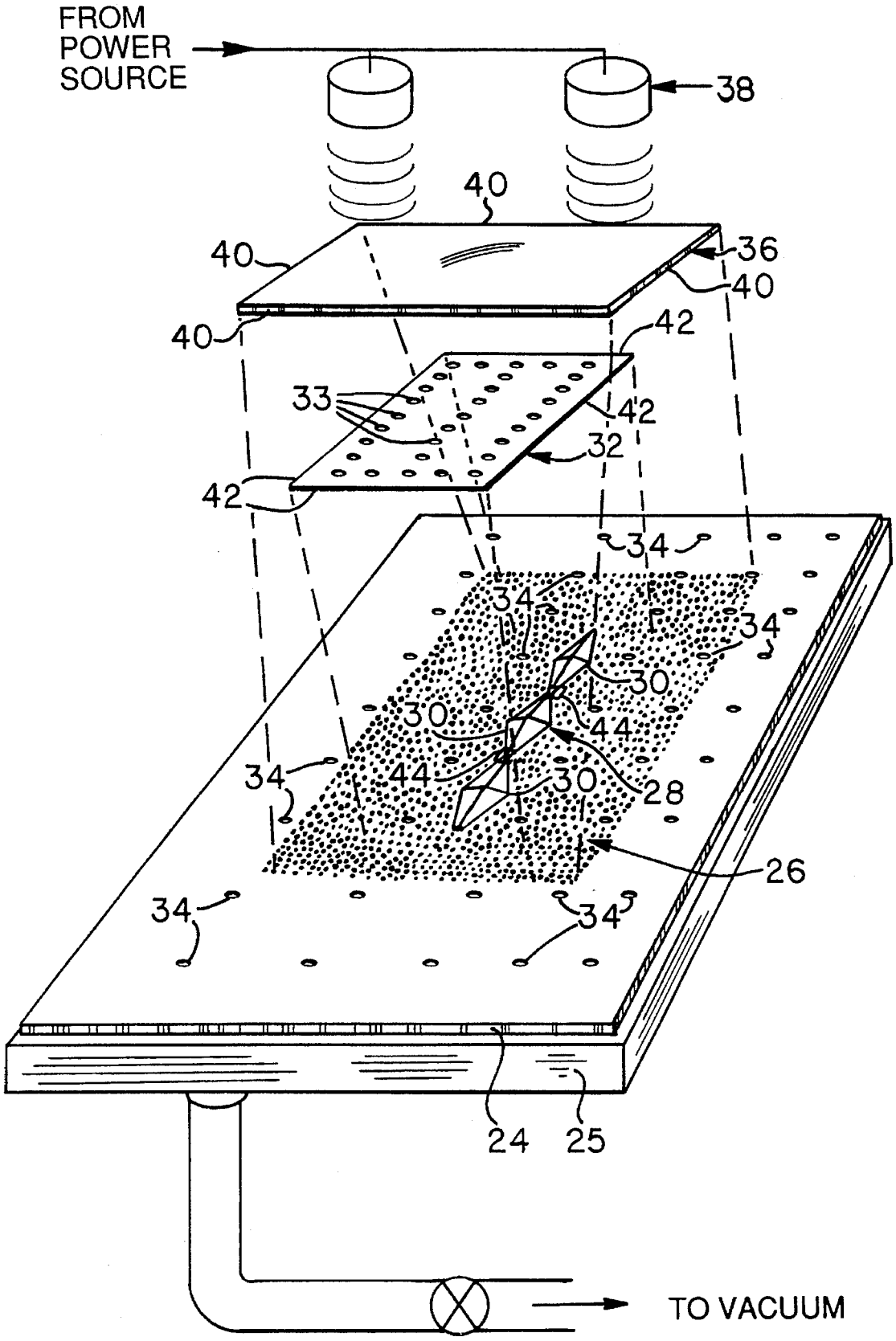
FIG. 2 is a perspective view of a skin packaging process according to this invention.

FIG. 2 illustrates a skin packaging process that overcomes disadvantages of the prior art. A substantially-rigid, punctured, backing sheet 24 comprising, for example, cardboard or card stock is positioned over a vacuum source 25 shown schematically. A predetermined portion of the backing sheet 24 is covered in adhesive layer (the illustrated dotted surface) 26 which, in this embodiment, is a heat sensitive adhesive. The adhesive 26 can be applied selectively to the sheet at certain locations or can be applied over the entire backing sheet 24 according to this embodiment. In this example, only a portion of the sheets surface is covered with adhesive 26. The adhesive-covered area corresponds generally to the outline of the overlying skin layer which is described further below.

An article 28 which, in this embodiment, comprises a string of crystal jewels 30 is positioned within the adhesive area 26 of the backing sheet 24. Unlike the prior art, the article 28 is not covered directly with a flexible plastic skin. Rather, an intermediate layer or sheet 32 having a surface area sufficient to cover substantially the entire article and touch the backing sheet surface is first positioned over the article 28. The intermediate layer 32 in this embodiment comprises filter material such as REEMAY #2006 0.003 inch thickness polyester. The filter material is porous, thus allowing air to pass therethrough. The filter material according to this embodiment also includes a series of larger perforations 33 that can be on the order of ⅛–¼ inch in diameter. It should be noted that the vacuum applied through punctures 34 of the backing sheet 24 can permeate the porous filter material without the use of larger perforations 33. The larger perforations 33 are provided to allow adhesive 26 from backing sheet 24 to be exposed through the intermediate layer at predetermined locations (e.g. the perforations). This is described further below.

A flexible thermoplastic skin sheet 36 comprising, in this embodiment, polyethylene sheet, is provided over the intermediate layer 32 in order to securely seal the article 28 to the backing sheet 24. The skin sheet 36 is heated, in this embodiment while out of contact with the backing sheet 24 and article 28, by a heat source 38 shown schematically. Infra red heating can be utilized as a heat source according to this invention. The heated, skin sheet 36 is positioned over the prepositioned article 28 and intermediate layer 32. The skin sheet 36 is larger in surface area than the article 28 and the intermediate layer 32 so that the outer edges 40 of the skin sheet 36 extend outwardly beyond the edges 42 of the intermediate layer 32 to join directly and securely with the adhesive-coated surface of the backing sheet 24. Contact between the skin and the adhesive 26 of the backing sheet 24 under the influence of the vacuum causes the heated skin sheet 36 to conform to the backing sheet surface contour and adhere firmly to the backing sheet 24 at virtually all points of contact therebetween. Since the intermediate layer 32 is porous, according to this invention, the vacuum permeates it, drawing the skin 36 close to the article 28 in the vicinity of the intermediate layer 32.

As noted above, the skin sheet 36 also adheres to the adhesive through the perforations 33 along the peripheral edges of the intermediate layer 32. Thus, the skin sheet 36 is secured to the backing sheet 24 at positions that are relatively close to the edges of the article 28, providing a more secure package (See FIG. 4).

Since the intermediate layer 32 comprises a material that remains substantially inflexible despite exposure to heat, vacuum, and other conditions that would normally change the characteristics of the skin, it forms a "tent" around the article that limits the encroachment of the skin 36 towards the edges of the article 28 upon securing. The intermediate layer 32, hence forms a structural member that resists encapsulation by the skin 36. The intermediate layer 32 also separates the skin 36 from the underlying adhesive layer 26, thus reducing the strength of the adhesion of the skin to the backing sheet 24 in the region of the intermediate layer 32.

For the intermediate layer 32 to effectively form a tent around the object, thus preventing encapsulation, the intermediate layer should be sized so that its edges contact and extend along the backing sheet when the intermediate layer is draped over the article. In other words, if the edges of the intermediate layer do not touch, or only barely touch the backing sheet, then they will be drawn under the article by the skin upon exposure to the vacuum and object encapsulation will occur. Conversely, if the edges extend along the backing sheet, then the intermediate layer forms a substantially inflexible barrier that limits encapsulating movement of the skin sheet. The exact distance over which the intermediate layer's edges must contact the backing sheet is a function of the flexibility of the skin and the degree of the vacuum and is, thus, varied depending upon these conditions.

By providing perforations 33 to the backing sheet 24 at various intervals, such as ½ inch intervals, the extension of the skin sheet along the surface of the backing sheet can be increased, since the skin can contact the adhesive of the backing sheet at points relatively remote to the article through the perforations.

Figure 3:
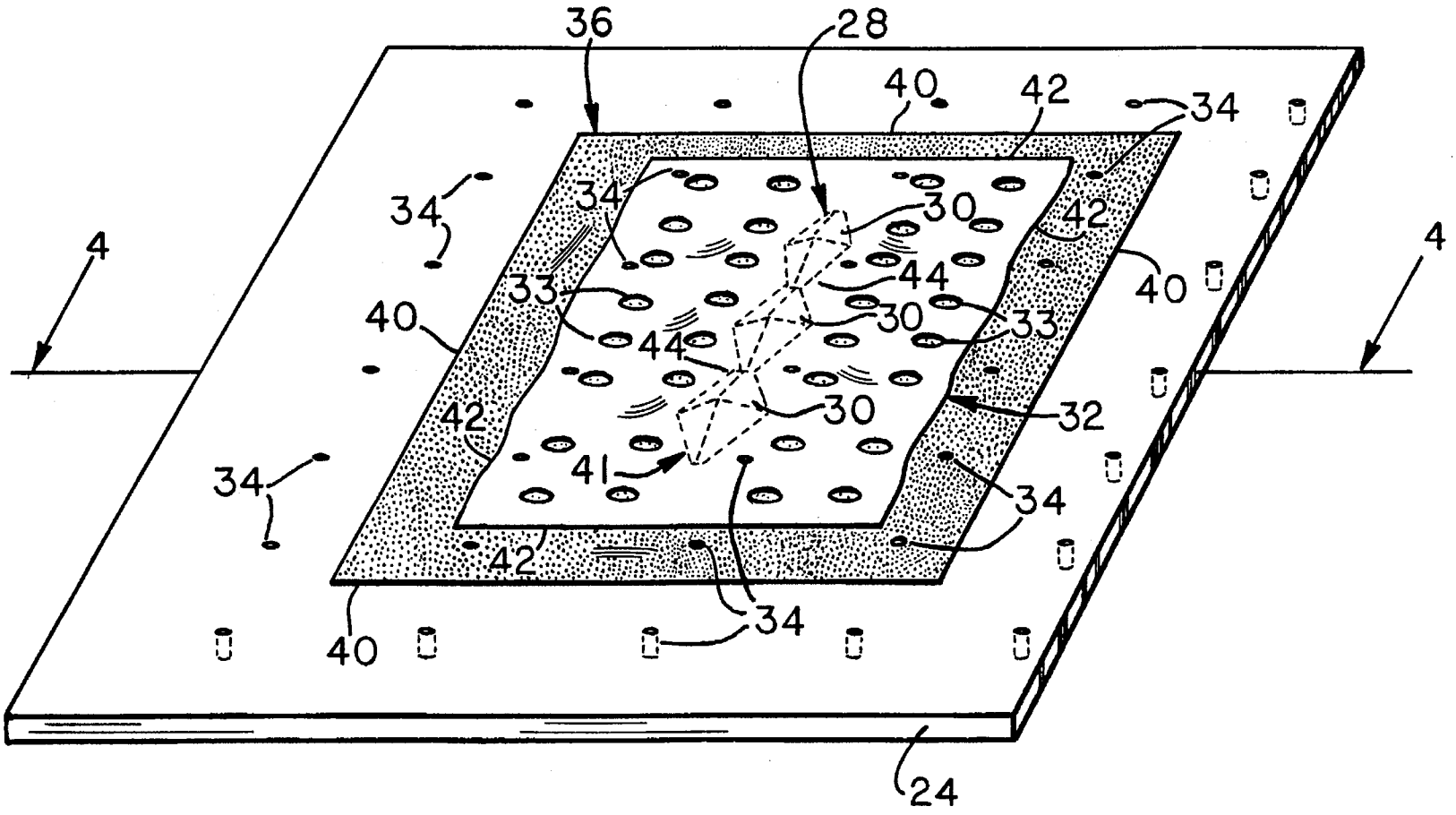
FIG. 3 is a perspective view of a completed skin package formed according to the process of FIG. 2.
Figure 4:
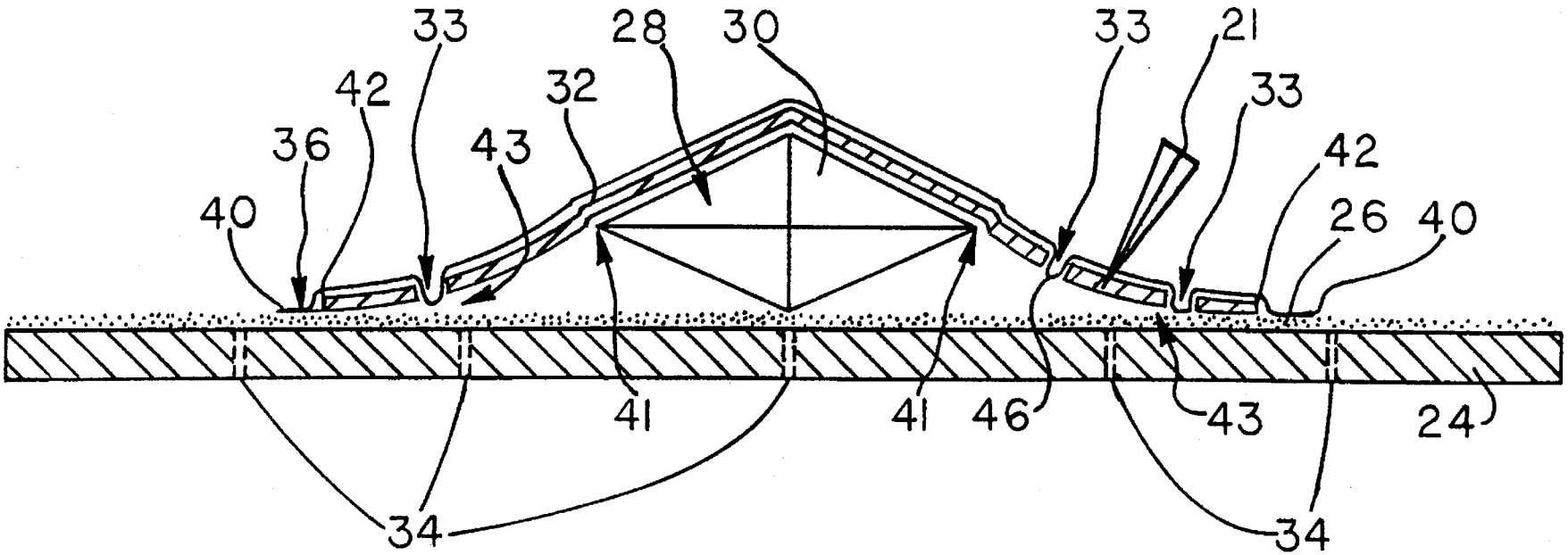
FIG. 4 is a side cross-section of the skin package taken along line 4—4 of FIG. 3.

A skin package profile obtained by following the foregoing method is illustrated in FIGS. 3 and 4. The article 28 is securely pressed against the backing sheet 24, but the skin sheet 36 only contacts the backing sheet 24 at points that are sufficiently remote from the edges of the article 28 to provide an easily-removable boundary 43 around the article 28. Accordingly, encapsulation of the article 28 is prevented and the article is easily-removable by cutting the skin layer 36 and intermediate layer 32 around the article 28 (with blade 21) at points that are a safe distance from the perimeter edges 41 of the article 28 within the unadhered boundary 43.

The vacuum generated by the source 25 typically draws the skin 36 through the perforations 33 into adhesive contact with the backing sheet However, since the flexibility of the skin 36 is limited, the perforations 33 should be located on a part of the intermediate layer 32 that is in contact with or relatively close to the backing sheet 24. The skin 36 cannot be pulled into contact with the backing sheet surface if the perforations are spaced too far above the backing sheet surface. The skin 36 generally is not flexible enough to be drawn through the perforations over a great distance. Rather, the skin 36 can only extend a small distance toward the backing sheet through the perforations 33. Consequently, these elevated areas of skin along the intermediate layer 32 remain out of adhesive contact with the backing sheet 24 and are easily removable upon cutting. Such an area 46 is illustrated in FIG. 4 in which the skin has been pulled through the perforation 33 but is still out of contact with the backing sheet 24.

To ensure that at least some perforations 33 are positioned to allow adhesive contact between the skin 36 and backing sheet 24 therebetween, an intermediate layer is constructed so that perforations 33 are spaced at regular intervals across the intermediate layer. Accordingly, perforations that are positioned along portions of the intermediate layer that are either in contact with, or relatively close to the backing sheet will allow skin 36 drawn therethrough to contact the backing sheet 24, while perforations that are positioned on the layer at location spaced more distantly from the backing sheet maintain the skin out of contact with the backing sheet as described above. By providing perforations at ¾–1 inch spacings, across the surface of the intermediate layer, the sheet can be variously positioned on a crystal jewel-sized article without carefully aligning the perforation with the article. This is because the perforations of the intermediate layer, owing to their repeated spacings, are typically present on portions of the intermediate layer that are relatively close to the backing sheet.

Alternatively, an imperforate intermediate layer 32 can be utilized according to this invention. Such a layer is sized so that it defines a perimeter that does not extend outwardly substantially further than the edges of the article 28 (e.g., the edges of the intermediate layer only extend to contact the backing sheet for a small distance). Thus, desired tenting still occurs, but the adhesive joint between the skin layer 36 and backing sheet 24 terminates relatively close to the edges of the article 28.

The intermediate layer 32 also serves to insulate the article from the hot flexible skin layer 36 during package construction. As such, once the skin 36 and intermediate layer 32 are cut away, they peel easily off of the article 28 and do not stick to any portion of it. This is particularly advantageous in the depicted example in which the article 28 comprises a delicate crystal jewel ornament chain. The skin layer 36 does not directly contact the delicate links 44 between jewel ornaments 30 and, thus, there is no need to forcibly remove skin layer 36 from the links 44 during unpacking.

The intermediate layer 32 utilized according to this embodiment comprises a porous filter material. Generally, such materials are constructed of synthetic and natural fibers such as paper, polymer fibers or fiberglass. These materials tend to be opaque and, thus, can visually obscure the underlying article 28. This invention also contemplates the use of other substantially inflexible porous materials that generate a tenting effect around the article but that are more transparent. Such materials can include certain forms of tissue, silkspan and porous plastics.

Figure 5:
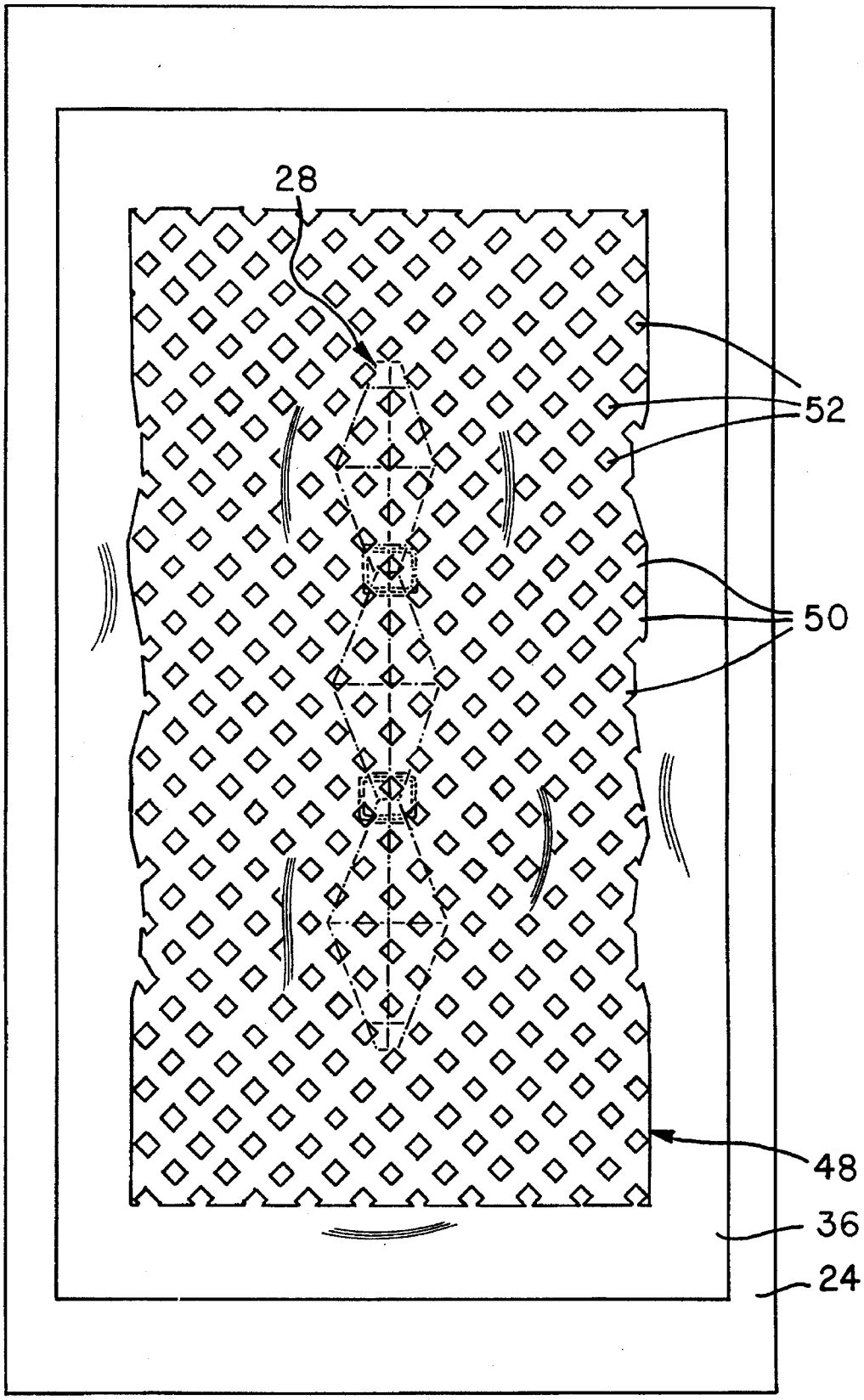
FIG. 5 is a plan view of a skin package formed according to an alternative embodiment of this invention.

The materials discussed above all include relatively small pores with optional intermittently positioned larger perforations. An intermediate layer can also be constructed utilizing a more mesh-like material such as the intermediate layer 48 illustrated in FIG. 5. The mesh-like layer 48 in this embodiment comprises criss-crossing strips of material. The material can be porous or can be constructed from thin enough strips 50 that the vacuum substantially penetrates the open spaces 52 between the strips to draw the skin 36 into close contact with the intermediate layer 48. One advantage of constructing the intermediate layer as a mesh is that the open spaces 52 ensure that the skin will be adhered as close as possible to the edges of the article 28, while still enabling tenting, thus providing for enhanced package security.

Similarly, while the particular skin packaging process illustrated herein utilizes heat and vacuum as conditions that bring the skin into a close conforming shape around the article, other processes for securing an article against a backing sheet with a flexible skin are also contemplated.

The foregoing has been a detailed description of a preferred embodiment. Various modifications and equivalents are contemplated without departing from the spirit and scope of this invention. Accordingly, this description is meant to be taken only by way of example and not to otherwise limit the scope of the invention.

What is claimed is:

1. A skin package for securing an article comprising:

a substantially-rigid, punctured, backing sheet defining a substantially-planar surface on at least a portion of the backing sheet;

an article having perimeter edges positioned on the planar surface of the backing sheet;

a substantially-inelastic intermediate sheet positioned over the article and having a first face that faces and contacts the article, the intermediate sheet having edges that extend outwardly further than the perimeter edges of the article and that contact the planar surface of the backing sheet with the first face of the intermediate sheet; and a skin sheet adhered to the planar surface of the backing sheet at predetermined locations proximate the intermediate sheet, and remote from the edges of the article, the skin sheet engaging a second face of the intermediate sheet opposite the first face, whereby the intermediate sheet restrains the skin sheet against close encapsulating contact of the article and wherein the intermediate sheet further comprises a material having pores that enable air infiltration therethrough constructed and arranged so that the skin sheet is drawn toward the backing sheet upon application of a suction adjacent the backing sheet and the skin sheet being flexible upon application of a predetermined sealing heat, the material of the intermediate sheet being substantially-inelastic in response to application of the predetermined sealing heat thereto.

2. A skin package as set forth in claim 1 wherein the intermediate sheet comprises a fibrous material having pores.

3. A skin package as set forth in claim 2 wherein the intermediate sheet comprises filter material.

4. A skin package as set forth in claim 3 wherein the intermediate sheet includes perforations at predetermined locations and wherein the skin sheet contacts and is adhered to the backing sheet through at least one of the perforations.

5. A skin package as set forth in claim 1 wherein the intermediate sheet includes perforations at predetermined locations and wherein the skin sheet contacts and is adhered to the backing sheet through at least one of the perforations.

6. A skin package as set forth in claim 1 wherein the backing sheet includes adhesive thereon to secure the skin sheet to the backing sheet.

7. A skin package as set forth in claim 1 wherein the skin sheet comprises a thermoplastic sheet that becomes elastic and adheres to the backing sheet in response to heating.

8. A skin package as set forth in claim 1 wherein the skin sheet includes edges that extend outwardly further than the edges of the intermediate sheet and that contact the planar surface of the backing sheet.

9. A skin packaged article constructed by a process comprising the steps of:

providing a substantially-rigid, punctured, backing sheet defining a substantially-planar surface along at least a portion of the backing sheet;

positioning an article on the planar surface of the backing sheet, the article having perimeter edges;

overlaying a substantially-inelastic intermediate sheet over the article so that a first face of the intermediate sheet contacts and faces the article, the intermediate sheet having edges that extend outwardly beyond the perimeter edges of the article and that contact the planar surface of the backing sheet with the first face of the intermediate sheet;

applying a skin sheet over a second face of the intermediate sheet opposite the first face, the skin sheet being adhered to the planar surface of the backing sheet at points proximate the intermediate sheet and remote from the perimeter edges of the article; and wherein the step of overlaying includes providing an intermediate sheet comprising a material having pores that enable air infiltration therethrough and wherein the step of applying includes applying a suction adjacent the first face of the intermediate sheet to draw the skin sheet toward the backing sheet through action of the suction through the pores and wherein the step of applying further includes exposing the skin sheet to predetermined heat to enhance flexibility of the skin sheet, the intermediate sheet remaining substantially-inelastic upon exposure to the predetermined heat.

10. A skin packaged article as set forth in claim 9 wherein the skin sheet includes edges and the edges extend outwardly further than the edges of the intermediate sheet, the edges of the skin sheet being adhered to the planar surface of the backing sheet, 11. A skin packaged article constructed by a process comprising the steps of:

providing a substantially-rigid, punctured, backing sheet defining a substantially-planar surface along at least a portion of the backing sheet;

positioning an article on the planar surface of the backing sheet, the article having perimeter edges;

overlaying a substantially-inelastic and porous intermediate sheet over the article so that a first face of the intermediate sheet contacts and faces the article, the intermediate sheet having edges that extend outwardly beyond the perimeter edges of the article and that contact the planar surface of the backing sheet with the first face of the intermediate sheet; and applying a skin sheet over a second face of the intermediate sheet opposite the first face, the skin sheet being adhered to the planar surface of the backing sheet at points proximate the intermediate sheet and remote from the perimeter edges of the article wherein the step of applying includes applying a suction through a perforation in the backing sheet to draw the skin sheet toward the backing sheet, each of the article, the intermediate sheet and the skin sheet being located relative to the backing sheet so that the intermediate sheet tents about the article to resist encapsulation by the skin sheet of the article.

12. A skin packaged article constructed by a process comprising the steps of:

providing a substantially-rigid, punctured, backing sheet defining a substantially-planar surface along at least a portion of the backing sheet;

positioning an article on the planar surface of the backing sheet, the article having perimeter edges;

overlaying a substantially-inelastic and porous intermediate sheet over the article so that a first face of the intermediate sheet contacts and faces the article, the intermediate sheet having edges that extend outwardly beyond the perimeter edges of the article and that contact the planar surface of the backing sheet with the first face of the intermediate sheet; and wherein the step of overlaying the substantially-inelastic intermediate sheet includes overlaying an intermediate sheet having a perforation therein and wherein the step of applying the skin sheet includes adhering the skin sheet to the planar surface of the backing sheet through the perforation of the intermediate sheet.

* * * * *